United States Patent [19]

Thompson et al.

[11] 4,036,546

[45] * July 19, 1977

[54] PARTS COMPRISING A METAL STRAP, U-SHAPED METAL CLIP, AND ADJUSTABLE CLAMPING MEANS, FOR MAKING AN ELECTRICAL TERMINAL ASSEMBLY

[76] Inventors: John T. Thompson, 244 Loring St., Los Angeles, Calif. 90024; George W. Gillemot, 2331 20th St., Santa Monica, Calif. 90405

[ * ] Notice: The portion of the term of this patent subsequent to Oct. 17, 1989, has been disclaimed.

[21] Appl. No.: 562,436

[22] Filed: Mar. 27, 1975

Related U.S. Application Data

[63] Continuation of Ser. No. 419,135, Nov. 26, 1973, abandoned, which is a continuation-in-part of Ser. No. 286,078, Sept. 5, 1972, abandoned, which is a continuation-in-part of Ser. No. 107,949, Jan. 20, 1971, abandoned.

[51] Int. Cl.[2] ..... H01R 3/02; H01R 7/08

[52] U.S. Cl. ..... 339/95 R; 24/265 R; 24/265 A; 174/78; 403/373

[58] Field of Search ..... 174/88 R, 94 R, 78, 174/885, 75 R, 76; 339/95 R, 95 A, 276 T, 277 R, 14 R, 266 R, 277 C, 263 R, 203 L; 29/628, 629; 24/265 A, 265 BC, 265 EC, 265 R; 403/373, 345

[56] References Cited

U.S. PATENT DOCUMENTS

| | | | |
|---|---|---|---|
| 907,542 | 12/1908 | Vogel | 24/20 LS X |
| 1,971,809 | 8/1934 | Bjorndal | 339/277 C X |
| 2,083,606 | 6/1937 | Johansson | 339/266 R |
| 2,250,280 | 7/1941 | Starbird | 339/95 A X |
| 3,150,221 | 9/1964 | Bollmeier | 174/76 X |
| 3,323,184 | 6/1967 | Reiter | 24/265 A X |
| 3,676,836 | 7/1972 | Gillemot et al. | 174/78 X |
| 3,699,494 | 10/1972 | Thompson et al. | 339/14 R |
| 3,725,580 | 4/1973 | Thompson et al. | 174/78 X |
| 3,732,354 | 5/1973 | Thompson et al. | 174/88 |
| 3,787,795 | 1/1974 | Thompson et al. | 339/14 R |
| 3,798,585 | 3/1974 | Thompson et al. | 339/95 R X |

*Primary Examiner*—Laramie E. Askin
*Attorney, Agent, or Firm*—Harris, Kern, Wallen & Tinsley

[57] ABSTRACT

A method and article for use in making a high strength positive solderless electrical connection using a strap conductor anchored to a clamping bolt by a tempered spring clip formed with sharp crested projections. The article and method have widely varied applications including the grounding of the thin shield of a shielded cable as a mechanical tie and electrical tie around a splice between shielded cables thereby isolating the spliced connections from cable tension forces, and many other uses.

4 Claims, 5 Drawing Figures

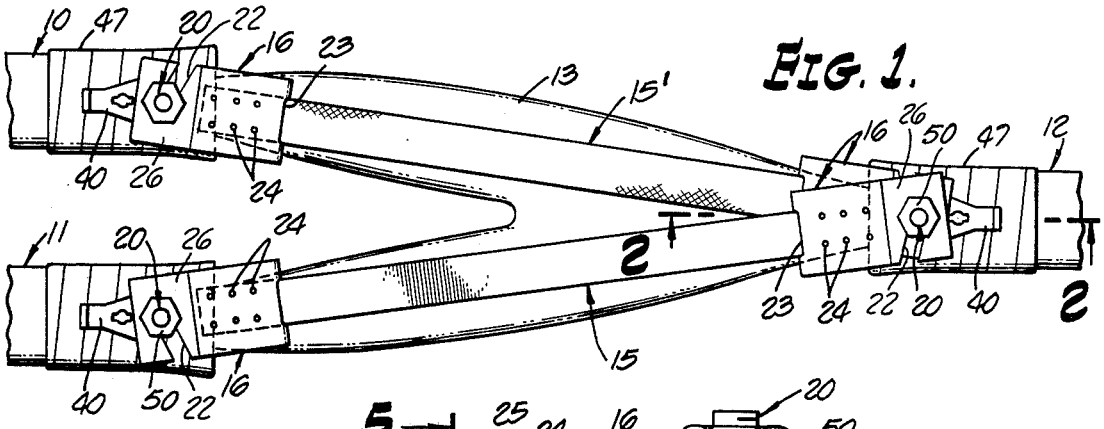
FIG. 1.
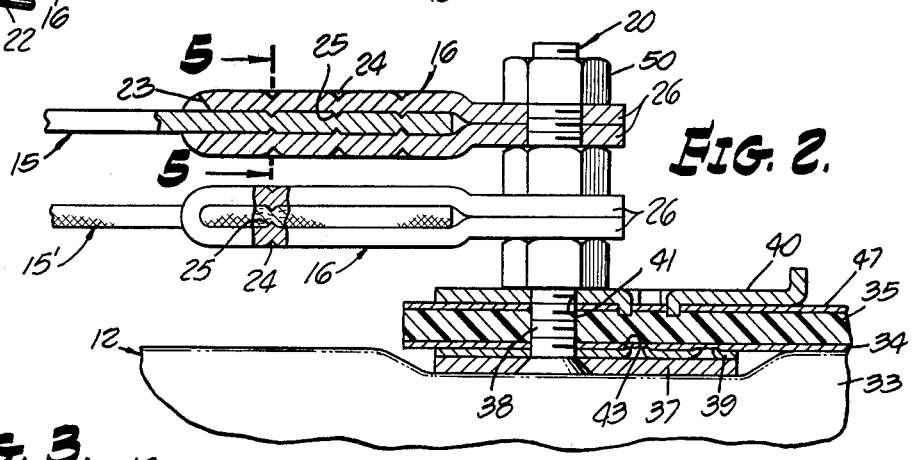
FIG. 2.
FIG. 3.
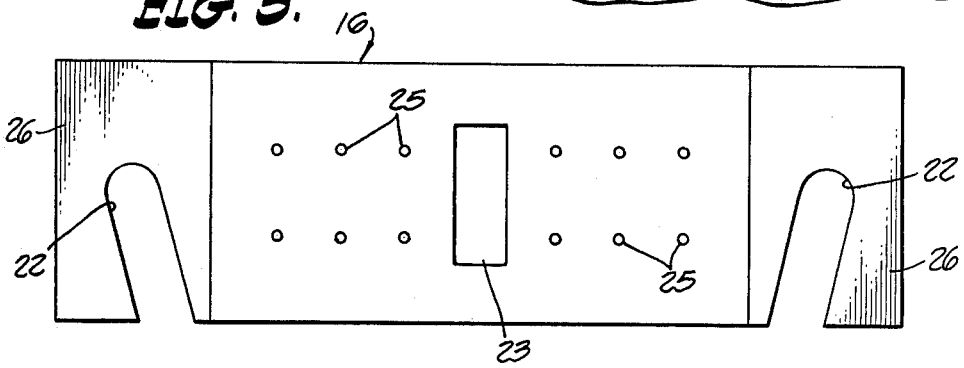
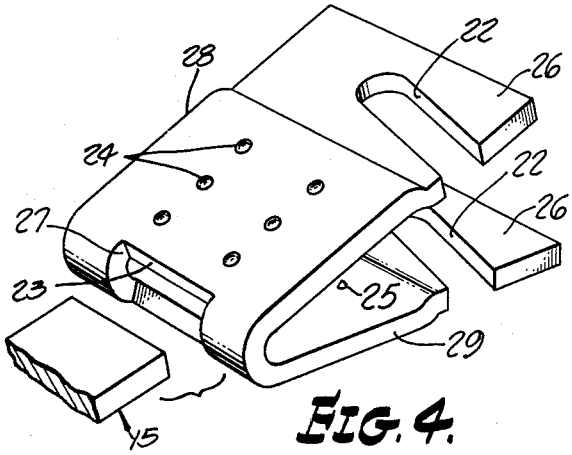
FIG. 4.
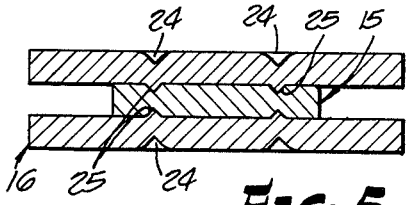
FIG. 5.

PARTS COMPRISING A METAL STRAP, U-SHAPED METAL CLIP, AND ADJUSTABLE CLAMPING MEANS, FOR MAKING AN ELECTRICAL TERMINAL ASSEMBLY

This application is a continuation of our copending application for U.S. Letters Patent, Ser. No. 419,135, filed Nov. 26, 1973, and now abandoned. Ser. No. 419,135 is a continuation-in-part of our application for U.S. Letters Patent, Ser. No. 286,078, filed Sept. 5, 1972, and now abandoned which is a continuation-in-part of our application for U.S. Letters Patent Ser. No. 107,949, filed Jan. 20, 1971, and now abandoned.

This invention relates to electrical connectors and more particularly to an improved method and versatile solderless terminal technique using heavy gauge strap-type conductors and a tempered U-shaped clamping clip and bolt to make a heavy duty load transmitting electrical connection.

Providing a positive rugged electrical connection between fragile type electrical shields and ground presents serious problems to which much designer attention has been given. Electrical shields are customarily formed of fine mesh or sheet foil-like material surrounding conductors or components in need of shielding. Irrespective of whether the shield is mesh or sheet foil, it has low inherent mechanical strength. In addition to the need for supplementing its mechanical strength is the need for providing a large area conductive path for high amperage currents sometimes carried by these shields and required to be grounded. Even though the current commonly present in the shield is the more customary micro-type, it is equally important that there by a high efficiency, low-resistance conductive path between this shield and ground capable of carrying these currents as well as emergency heavy loads occasioned by lightning, accidents and the like. Likewise, where the bonding assembly spans a cable splice, the bonding assembly of the invention is employed additionally to sustain and transfer cable tensile stresses across the splice thereby protecting these connections from the risk of strain.

Various types of solderless connections intended to meet the foregoing and other requirements encountered in providing bonding connections to ground have been advanced by designers but each of these is found deficient and less than satisfactory in one or more respects. Illustrative of the problems is that presented when the conductors of two or more shielded cables are spliced. The multiplicity of fine conductors customarily involved should be free of stress and strain in the area of the splice. The high strength cable sheath normally relied upon to carry a principal portion of the cable tensile forces must be cut away in the area of the splice and is therefore unavailable to transmit tensile forces across the splice. Additionally, it is necessary to provide a suitable and reliable electrical connection across the splice and interconnecting the shields of each cable.

These several important requirements are fulfilled to a highly satisfactory degree by the simple technique and components provided by the present invention. These include large area anchor shoe means between which the cable shield and heavy duty sheath are sandwiched under high pressure using a threaded bolt protruding therethrough and beyond the exterior of the cable sheath. These anchor assemblies, attached to each of the cables being spliced together, are thereafter mechanically and electrically interconnected by high strength ductile bonding straps of either bar stock or braided conductors the ends of which are anchored to the clamping bolt of the first mentioned anchor assemblies by a one-piece heavy gauge U-shaped clip substantially wider than the strap and the bight portion of which is formed for telescopic assembly over an associated end of the strap, following which the clip legs are squeezed against the bonding strap by tightening the clamping nut. The bonding strap need only be cut to the proper length to span the particular cable splice and it is unnecessary to drill holes or to use any tool except a wrench for the clamping nut. Owing to the absence of perforations in the strapping, it is easily cut to the precise length required to transmit tensile stresses across cable splice connections and its entire cross-sectional area from end to end of the strap is available both for mechanical strength and electrical loads. The gripping action between the solderless clip and the bond strap is greatly enhanced by the provision of a multiplicity of sharp crested projections punched or coined into the tempered clip and which readily penetrate and become embedded in the strap as a clamping nut is tightened. The parts may be disassembled and reassembled repeatedly without loss of efficiency or effectiveness, either electrically or mechanically. Both the bonding strap and the terminals for its ends are formed from standard solid strip or a multiplicity of flat-braided conductors without need for machine work of any kind and will withstand the roughest kind of handling without risk of damage.

Accordingly, it is a primary object of this invention to provide an improved method and simple low cost components designed for high strength mechanical and electrical anchorage to one another using a minimum of tools and skill.

Another object of the invention is the provision of a simple, easily performed technique for completing a high strength mechanical and high capacity solderless electrical connection in the field and particularly useful in completing grounding and bonding connections for electrical equipment, shielded cables and the like.

Another object of the invention is the provision of a combined bonding and tension transfer assembly spanning a cable splice and effective to provide a simple high strength stress transfer mechanical connection lengthwise of a cable splice and a high amperage electrical connection between the cable shield jackets.

Another object of the invention is the provision of a low cost, rugged, one piece, solderless terminal designed to provide a high strength mechanical bond to strap stock sufficiently strong to develop the strength of both the strap and the solderless terminal and the full electrical capacity of each.

These and other more specific objects will appear upon reading the following specification and claims and upon considering in connection therewith the attached drawing to which they relate.

Referring now to the drawing in which a preferred embodiment of the invention is illustrated:

FIG. 1 is a plan view of a splice between three cables electrically and mechanically interconnected in accordance with the principles of this invention using one preferred embodiment of the bonding strap and solderless connector of the invention;

FIG. 2 is a fragmentary cross sectional view on an enlarged scale taken along line 2—2 on FIG. 1;

FIG. 3 is a plan view of the solderless connector per se prior to being bent into its preassembly configuration;

FIG. 4 is an exploded perspective view of the solderless connector and the adjacent end of the bonding strap; and FIG. 5 is a cross sectional view on an enlarged scale taken along line 5—5 on FIG. 2.

Referring initially more particularly to FIG. 1, there is shown three conventional multiconductor shielded cables 10, 11, 12 in general alignment with one another and having their conductors spliced together in known manner at 13. A suitable splice enclosure shroud would normally be added to enclose the splice in accordance with conventional practice but since this enclosure forms no part of the present invention it has not been shown. In this type of cable splice it is of paramount importance that the cable ends adjacent the opposite ends of the splice be mechanically interconnected by ties of adequate strength to avoid risk of straining any splice connection and readily tailored precisely to size in the field without need for special tools or skilled labor. This purpose is accomplished according to this invention by the high strength bonding straps 15, 15′ and the U-shaped solderless terminal clips 16 telescoped over the opposite ends of these straps and clamped to anchor terminal assemblies 20, 20 rigidly clamped to the sheaths of cables 10, 11, 12.

In order to make maximum use of the strength and electrical properties of bonding straps 15, 15′, these straps are cut to length from heavy gauge high conductivity ductile strip stock such as copper or aluminum, or a wide strap of a multiplicity of fine ductile braided conductors. It will be understood that strap 15 is of solid strip stock whereas strap 15′ comprises braided conductors of the type commonly used to ground vehicle storage batteries. Either type of strap is rectangular in cross section and preferably free of openings or punchouts from end to end. Such openings would very materially reduce the strength and electrical capacity of the strapping which at times may be called upon to carry high amperage electrical charges such as those originating from lightning or from contact of the cable with a high tension power source. Furthermore, the presence of a series of perforations distributed lengthwise of strap 15, 15′ necessitates a compromise when selecting one of these perforations for connection to the clamping bolt of an anchorage facility such as assemblies 20. As will become evident from the following portions of this disclosure, the present invention avoids the need for compromise of any character and the straps may be cut to the precise length required to span the distance between the clamping bolts of assemblies 20 after the latter have been fully installed in each cable.

The simple means employed in this invention to provide the powerful mechanical and electrical junctions between the ends of straps 15, 15′ and an anchor point will be best understood by reference to FIGS. 3, 4 and 5. FIG. 3 shows one of the clips 16 while its opposite ends lie flat and in a common plane. The clip is formed from heavy gauge strip stock of good conductivity material and which is preferably readily hardened by heat treatment after the forming operations have been completed to render it substantially harder than straps 15, 15′. The strip is rectangular in cross section and formed with aligned bolt receiving slots 22 at its opposite ends as well as with a rectangular opening 23 crosswise of its mid portion sized to have a close telescopic fit over the end of straps 15 or 15′. Slots 22 open through one lateral edge and are inclined toward the bight portion as clearly appears from FIGS. 3 and 4. As shown, the underside of the strip is formed with depressions 24 (FIG. 5) while the opposite face is held against a suitable die. In consequence, the upper surface of the strip, as viewed in FIG. 3, has a multiplicity of low height protrusions 25 projecting outwardly from its surface. Desirably there are two or more rows of these protrusions positioned to lie inwardly of the opposite lateral edges of straps 15, 15′ in the assembled position of these parts and their ends are preferably sharp crested so as to penetrate into the strap as the clip legs are clamped toward one another.

The strip is next bent into the U configuration shown in FIG. 4 so that opening 23 is located in the bight portion 27 of the clip so formed and protrusions 25 project toward one another. Legs 28, 29 of clip 16 diverge from the bight portion and the openings or slots 22 are positioned to be in alignment with one another as these legs are closed. The spacing between the inner surfaces of legs 28 and 29 at bight portion 27 when the legs are closed to lie parallel approximates or is slightly less than the thickness of the conductor straps with the result that the forced flexure of the legs toward one another permits the legs to be closed until all juxtaposed surface areas of the legs and straps 15 or 15′ are in high pressure contact. The substantially greater hardness of the U-shaped clip 16 relative to the ductile straps results in the sharp crested projections 25 penetrating the straps until the strap and leg surfaces bottom in high pressure contact as is best illustrated in FIG. 5.

It will also be understood that the free end portions 26 of the clip legs are preferably offset toward one another by a distance approximating one half of the thickness of straps 15, 15′ whereby these offset portions tend to bottom against one another during final tightening of the clamping bolt. The junction of the offsets with the main body of the clip legs also provides a stop limiting the insertion of the strap to a position close to but spaced from the shank of the clamping bolt. This assures utilization of a maximum of the juxtaposed surface area between the clip legs and the end portion of the strap.

Referring to FIG. 2, there is shown an illustrative but preferred high strength solderless anchor assembly found highly satisfactory in anchoring the strap clamping clips 16 to each of the cables and their shields. It will of course be understood that other modes of anchoring the bonding strap and its clip to the cable may be used. It will likewise be understood that straps 15, 15′ and clips 16 may be anchored to various other structures as well as to conductors of a wide variety and, in fact, to any structure having a threaded shank over which the legs and slots 22 of clip 16 can be inserted and clamped together.

Cable 12 has its conductors, not shown, enclosed within a thin insulative sleeve 33 which in turn is enclosed by a thin foil-like metallic shield 34 embraced on its exterior by a thick tough high strength elastomeric sheath 35. Anchor assembly 20 comprises an inner metallic shoe 37 fixed to a threaded shank 38, a thin resilient shim 39, and an outer shoe 40 having a hole 41 therethrough fitting loosely over threaded shank 38. The inner and outer shoes 37, 40 are formed of large area rigid plates similarly curved to fit the cable and having their adjacent faces congruous with one another to provide large area gripping surfaces between which shield 34 and sheath 35 are clamped when the shoes are forced toward one another by the clamping nut. Spring shim 39 fits loosely over the shank 38 and has a multiplicity of sharp edged burrs 43 facing outwardly and effective to scratch through any insulative film often present on the inner surface of shield 34 thereby assuring an excellent electrical contact with this shield.

The assembly of anchor assembly 20 to the cable is preferably carried out by slitting shield 34 and sheath 35 lengthwise from one end of the cable, this slit preferably being made on the opposite side of the cable from the anchor assembly. This permits the shield and sheath to be expanded away from the conductors sufficiently to expedite forming assembly holes for shank 38 and inserting the inner shoe and shank from the inner ends of these openings. This operation having been accomplished, the operator compresses the shield and sheath back against the conductors and preferably secures them in place by snug servings 47 of friction tape. The outer shoe 40 is then placed over shank 38 along with a clamping nut which is wrenched tight to force the inner and outer shoes 37, 40 and shim 39 into high pressure contact with shield 34 and sheath 35. The strength and pressure of these members in contact with the two cable layers 34, 35 is sufficiently great as to develop the full tensile strength of these layers. Additionally, a highly effective electrical contact is made with the shield without risk of tearing or damaging it.

The operator proceeds to assemble the anchor assemblies 20 to each of the cable ends in the manner just described. Thereafter, bonding straps 15, 15' are installed, each of the straps being cut to the particular length required to span the distance between the adjacent ends of the offset portions 26 of the clips 16 when the associated cable ends are in their desired taut positions with no stress on the spliced conductors. No other operation is required other than to insert the ends of the straps through openings 23 in the bight portions of a pair of clips 16, and to insert the slots or openings 22 over the outer ends of shank 38. Additional clamping nuts 50 are then tightened against the outer one of the clip legs. During this tightening operation, projections 25 are forced into high pressure contact with the strap or actually bite into and penetrate the surface of each of the straps so as to interlock therewith while at the same time providing high pressure electrical contact between the clip legs and the strap. In case more than two cables are being spliced together, it is necessary to assemble more than one of the clips 16 to a single shank 38. In this case, the clips are individually assembled and closed by tightening a separate clamping and lock nut. Although not shown, it will be understood that each of the straps may be enshrouded in a sleeve of insulation material.

The completed assembly has the appearance shown in FIG. 1 wherein each shank of the solderless anchor assemblies 20, 20 is held rigidly spaced apart the desired distance to assume the tension loads acting in the individual cable sheaths while protecting the spliced conductors 13 from these tensile strains.

While the method of and article for making high strength solderless electrical connections herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. Parts for making a solderless terminal assembly, comprising:

a. an elongated heavy-gauge high-capacity wide strap of rectangular cross section and of ductile metal;

b. a long U-shaped clip of metal formed from heavy gauge strip stock of substantially greater width than said strap, said clip having a rectangular opening extending transversely of the bight portion thereof sized to receive one end of said strap inserted endwise therethrough, and said clip having a pair of aligned openings through the free ends of its legs, the legs of said clip having strap gripping areas which are provided with protrusions projecting from the inner surfaces of said clip legs, said protrusions being adapted to penetrate into opposite surfaces of the strap when said legs are clamped thereagainst; and c. adjustable clamping means mountable in said aligned openings for clamping and anchoring one end of said strap immovably between said gripping areas of said clip legs, when inserted therebetween, to provide a high capacity electrical and strong mechanical connection therebetween as said clamping means is tightened.

2. Parts as defined in claim 1 characterized in that said strap gripping areas have a length substantially greater than the width of said ductile strap.

3. Parts as defined in claim 1 characterized in that said clip is tempered and has a hardness substantially greater than said strap.

4. Parts as defined in claim 1 characterized in that said protrusions have sharp edges effective to penetrate into said strap.

* * * * *